US009126069B2

(12) United States Patent
Ochi

(10) Patent No.: US 9,126,069 B2
(45) Date of Patent: Sep. 8, 2015

(54) PLAY EQUIPMENT

(75) Inventor: Yasushi Ochi, Kaizuka (JP)

(73) Assignee: BLD Oriental Co., Ltd. (JP)

( * ) Notice: Subject to any disclaimer, the term of this patent is extended or adjusted under 35 U.S.C. 154(b) by 146 days.

(21) Appl. No.: 13/816,787

(22) PCT Filed: Dec. 23, 2010

(86) PCT No.: PCT/JP2010/007463

§ 371 (c)(1),
(2), (4) Date: Feb. 13, 2013

(87) PCT Pub. No.: WO2012/023167

PCT Pub. Date: Feb. 23, 2012

(65) Prior Publication Data

US 2013/0150215 A1 Jun. 13, 2013

(30) Foreign Application Priority Data

Aug. 19, 2010 (JP) ..... 2010-183654

(51) Int. Cl.

| | |
|---|---|
| ***A63B 9/00*** | (2006.01) |
| ***A63B 4/00*** | (2006.01) |
| ***A63B 17/02*** | (2006.01) |
| ***A63B 24/00*** | (2006.01) |
| ***A63B 26/00*** | (2006.01) |
| ***A63B 71/04*** | (2006.01) |

(Continued)

(52) U.S. Cl.

CPC ... *A63B 9/00* (2013.01); *A63B 4/00* (2013.01); *A63B 17/02* (2013.01); *A63B 24/0062* (2013.01); *A63B 26/003* (2013.01); *A63B 71/04* (2013.01); *A63G 31/02* (2013.01); *A63B 2022/025* (2013.01); *A63B 2024/0065* (2013.01)

(58) Field of Classification Search

CPC .... A63B 4/00; A63B 21/025; A63B 2208/12; A63B 2009/006; A63B 24/0084; A63B 26/00; A63B 23/0464

USPC ..... 482/23, 34–38, 44–48; D21/814; 472/1, 472/27–31, 48, 127, 134, 137; 473/439

See application file for complete search history.

(56) References Cited

U.S. PATENT DOCUMENTS 1,589,131 A * 6/1926 Eakin ..... 482/23
2,959,413 A * 11/1960 Rosenzweig et al. ..... 482/35

(Continued)

FOREIGN PATENT DOCUMENTS

JP 2008073497 A 4/2008
WO 2006087767 A1 8/2006

OTHER PUBLICATIONS

International Search Report; International Application No. PCT/JP2010/007463; Feb. 1, 2011; Japanese Patent Office.

*Primary Examiner* — Stephen Crow
*Assistant Examiner* — Andrew S Lo
(74) *Attorney, Agent, or Firm* — Stevens & Showalter LLP

(57) ABSTRACT

To provide play equipment on which a user can log-walk and which is capable of interfering with the user's walking.
The play equipment is provided with a pair of pedestals that are placed on the floor, a shaft on which the user can walk, an obstacle that interferes with the user's walking and a driving mechanism. The two ends of the shaft are supported rotatably on the pair of pedestals. The obstacle is disposed on the shaft. A drive motor is provided in the pedestal and a drive mechanism drives the shaft by the rotation of the drive motor.

10 Claims, 8 Drawing Sheets

(51) Int. Cl.
*A63G 31/02* (2006.01)
*A63B 22/02* (2006.01)

(56) References Cited

U.S. PATENT DOCUMENTS

| | | | | | |
|---|---|---|---|---|---|
| 3,211,452 | A | * | 10/1965 | Ahrens | 482/35 |
| 3,419,272 | A | * | 12/1968 | Miller et al. | 473/439 |
| 3,545,747 | A | * | 12/1970 | Thomas | 273/449 |
| 3,621,602 | A | * | 11/1971 | Barcus et al. | 446/491 |
| 3,703,289 | A | * | 11/1972 | Hohman | 473/439 |
| 3,806,118 | A | * | 4/1974 | Way | 273/449 |
| 3,887,179 | A | * | 6/1975 | Klepper et al. | 472/127 |
| 4,092,023 | A | * | 5/1978 | Hazen | 473/454 |
| 4,378,112 | A | * | 3/1983 | Goldstein | 482/34 |
| 4,519,789 | A | * | 5/1985 | Halford et al. | 446/444 |
| 4,775,144 | A | * | 10/1988 | Shipman | 472/44 |
| 4,936,578 | A | * | 6/1990 | Hudson, Sr. | 473/439 |
| 5,334,100 | A | * | 8/1994 | Bailey | 472/127 |
| 5,443,012 | A | * | 8/1995 | Underbrink et al. | 104/53 |
| 5,769,756 | A | * | 6/1998 | Parks | 482/34 |
| 6,044,766 | A | * | 4/2000 | Underbrink et al. | 104/53 |
| 6,095,950 | A | * | 8/2000 | Katz | 482/35 |
| 6,464,620 | B1 | * | 10/2002 | Hettrich | 482/51 |
| 6,490,997 | B1 | * | 12/2002 | Biermann et al. | 119/706 |
| 7,273,443 | B1 | * | 9/2007 | Martinez et al. | 482/35 |
| 7,377,856 | B2 | * | 5/2008 | Nickelson | 472/106 |
| 7,568,998 | B2 | * | 8/2009 | Gallus et al. | 482/35 |
| 7,810,392 | B2 | * | 10/2010 | Kitagawa | 73/379.01 |
| 7,959,513 | B2 | * | 6/2011 | Ochi | 472/29 |
| 7,981,004 | B2 | * | 7/2011 | Liggett et al. | 482/35 |
| 8,066,578 | B2 | * | 11/2011 | Liggett | 472/136 |
| 2002/0091041 | A1 | * | 7/2002 | Mantooth | 482/35 |
| 2002/0177508 | A1 | * | 11/2002 | Eyman et al. | 482/23 |
| 2003/0022761 | A1 | * | 1/2003 | Brereton | 482/35 |
| 2003/0192486 | A1 | * | 10/2003 | DeRaspe-Bolles et al. | 119/706 |
| 2005/0164834 | A1 | * | 7/2005 | Paulete | 482/37 |
| 2006/0094568 | A1 | * | 5/2006 | Underbrink et al. | 482/35 |
| 2008/0149042 | A1 | * | 6/2008 | Halpern | 119/706 |
| 2010/0179029 | A1 | * | 7/2010 | Ochi | 482/35 |

* cited by examiner (A)

(B)

PLAY EQUIPMENT

TECHNICAL FIELD

This instant invention relates to a play equipment, and more specifically, relates to a play equipment to do so-called log walk.

BACKGROUND ART

A playground equipment of so-called log-walk horizontally placing a log of the thickness capable of walking, is installed in the parks. The playground equipment of the log-walk is popular with guardian as a playground equipment for nurturing balance sense. There is much demand for playground equipment maker because it can be configured easily. An example of the indoor playground equipment of the log-walk is disclosed in Japanese Unexamined Pat. App. Pub. No. 2000-262646.

SUMMARY OF THE INVENTION

The playground equipment of the log-walk can be easily configured like a technology of the disclosure in above patent document, but it is the simple configuration by placing the log against a support. Therefore it is difficult to keep user's (meaning infant or a young child, the same shall apply hereinafter) continual interest. Furthermore, the configuration of the playground equipment of the log-walk is simple, and it does not attract attention as compared to other playground equipments, so users playing with above playground equipment are relatively few. On the other hand, children tend to make continual interest against movement, so it can increase sustainment of user interest by working the log which is provided to the playground equipment. Therefore, a playground equipment of the log-walk capable of making the interest of the user has been requested.

The object of the invention is to offer a play equipment of so-called log-walk, which is installed in indoor amusement park and is capable of increased sustainment of user interest by simple configuration.

The play equipment of this invention to achieve the problem, is provided with a pair of pedestals that are placed on the floor, a shaft on which the user can walk, an obstacle that interferes with the user's walking and a driving mechanism. The ends of the shaft are supported rotatably on the pair of pedestals. The obstacle is disposed on the shaft. Furthermore, a drive motor is provided in the pedestal, and a drive mechanism drives the shaft by a rotation of the drive motor. According to the above configuration, the play equipment which can disturb the user's walking can be configured by driving the obstacle provided on the shaft. The play equipment that a user walks on the shaft is configured while avoiding obstacle driven, and play equipment capable of sustaining the more interest of the user can be configured.

In accordance with an aspect of the present invention, it is preferable that above drive mechanism is a rolling mechanism for turning the shaft and the obstacle is a spiral body. The play equipment capable of interfering with the user's walking is configured by rotating the spiral body. Alternatively, a lower end of a plurality of rings of the obstacle may be placed to the shaft.

It is preferable that above drive mechanism is provided with a strut, an upper swing pivotally supported by the strut upper part, and a crank mechanism for swinging the upper swing. By above configuration, the shaft is driven swingingly, and the obstacle placed on the shaft swings.

In accordance with an aspect of the present invention, it is preferable that the drive mechanism is provided with a strut support, a swing strut pivotally supported by the strut support, an upper swing pivotally supported by the swing strut upper part, and a crank mechanism for swinging the swing strut. By above configuration, at first a swing strut is swung by a drive mechanism, and the upper swing swings depending on how to get balance of the user, so the shaft can swing further complicatedly.

In accordance with an aspect of the present invention, the shaft may be a sloping shaft against floor, pivotally supported by the pedestal. By above configuration, it make a movement further complicatedly by rotating the shaft or swinging the shaft with inclined.

Furthermore, the displacement of one or both ends of the shaft may be controlled freely in intersection direction against longitudinal. Thereby, it can configure the play equipment capable of increased sustainment of user interest.

EFFECTS OF THE INVENTION

A play equipment of this invention comprises a pair of pedestals placed on a floor, a shaft for walking a user, an obstacle for interfering with the user's walking, and a drive mechanism. The ends of the shaft are supported rotatably on the pair of pedestals.

The obstacle is disposed on the shaft. Furthermore, a drive mechanism comprising a drive motor for driving the shaft is comprised. By driving the obstacle provided on the shaft, the play equipment which can disturb the user's walking can be configured. The play equipment that a user walks on the shaft is configured while avoiding the obstacle driven, so the play equipment capable of sustaining the more interest of the user can be configured.

DESCRIPTION OF THE PREFERRED EMBODIMENT

Detailed Description of the Preferred Embodiment 1

Figure 1:
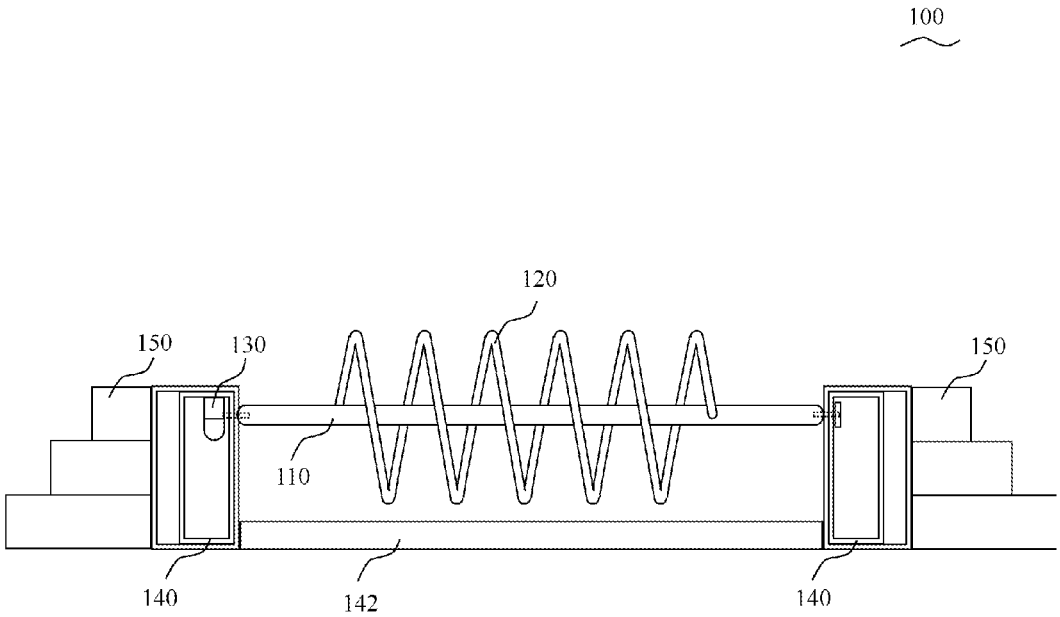
FIG. 1 is a front view illustrating an outlined configuration of a play equipment in accordance with an embodiment of the present invention.
Figure 2:
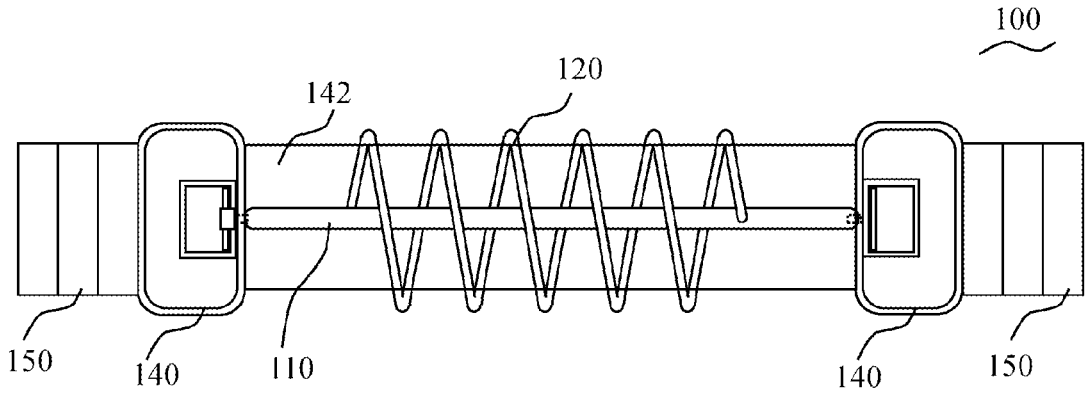
FIG. 2 is a top view illustrating an outlined configuration of a play equipment in accordance with an embodiment of the present invention.
Figure 2:
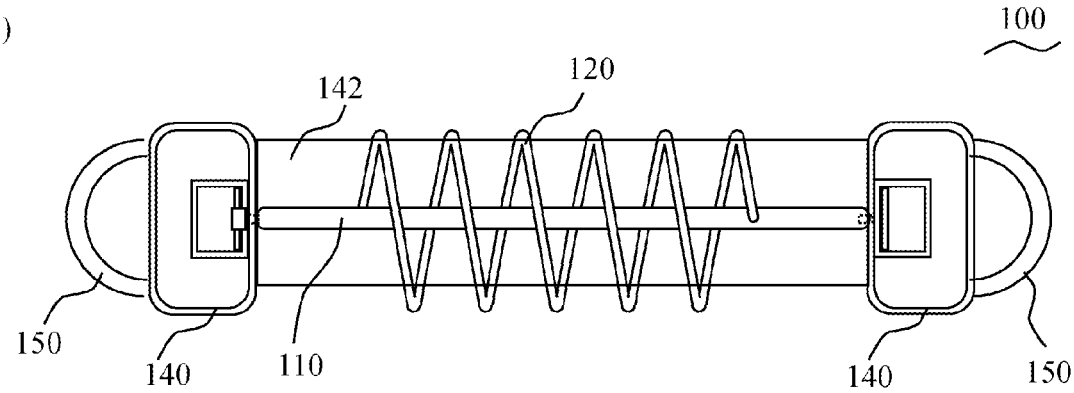

A specified embodiment of a play equipment 100 is explained hereinafter with reference to the accompanying drawings. FIG. 1 is an outline schematic view showing the collection a configuration of a play equipment 100 of this invention. FIG. 2 is an outline schematic view showing the whole configuration of a play equipment 100 of the present invention seen from the upper part. However, the details of the all parts which do not directly relate to the present invention will be omitted.

That is, as illustrated in FIG. 1, a play equipment 100 of this invention comprises a shaft 110, an obstacle and a drive mechanism. The shaft 110 is pivotally supported.

For example, a pair of cube type pedestals 140 are formed, and a bearing is provided in lateral face of both pedestals 140. Both ends of the shafts 110 are pivotally supported by the bearing. In the present embodiment, cross-sectional shape circle-shaped shaft 110 is employed.

An obstacle for interfering with the user's walking, over the shaft 110 is provided on the shaft 110. If the shape of the obstacle can disturb the user's walk, any shape may be used. For example, as shown in FIGS. 1 and 2, a pipe body of spiral shape as the obstacle is formed. It uses iron, stainless steel, carbon or titanium, for materials of a pipe body (corresponding to a spiral body 120 of this invention) formed in the spiral shape preferably. In the present embodiment, iron pipe formed in the spiral shape is used. Instead of a pipe body, solid steel materials filled up with contents may be used.

The pipe body (obstacle) configured as above is fixed to a shaft 110. A play equipment 100 of this invention which the shaft 110 rotates by a rolling mechanism (corresponding to a drive mechanism of this invention) is configured. The following configuration is used as a rolling mechanism. That is, a rotation axis of the drive motor 130 fixed within pedestal 140 is fixed to one end of the shaft 110. The play equipment 100 of this invention is configured by rotating above shaft 110 by above drive motor 130. For example, a hollow shaft motor may be fixed to the upper part of the pedestal 140 as the drive motor 130. Furthermore, a step 150 for climbing to a pair of pedestals is fixed to the pedestal 140. As shown in FIG. 2 (B), a bent pipe member may be used as the step 150.

By using the play equipment 100 configured as above, the spiral body 120 rotates by a rotation of drive motor 130. Users walk on the shaft 110 while avoiding obstacle by passing through or stepping over the spiral body 120 rotating. A cushion 142 for preventing the injury of the users against user's fall, may be provided between a pair of pedestals 140 placed on lower part of the shaft 110.

Detailed Description of the Preferred Embodiment 2

Figure 3:
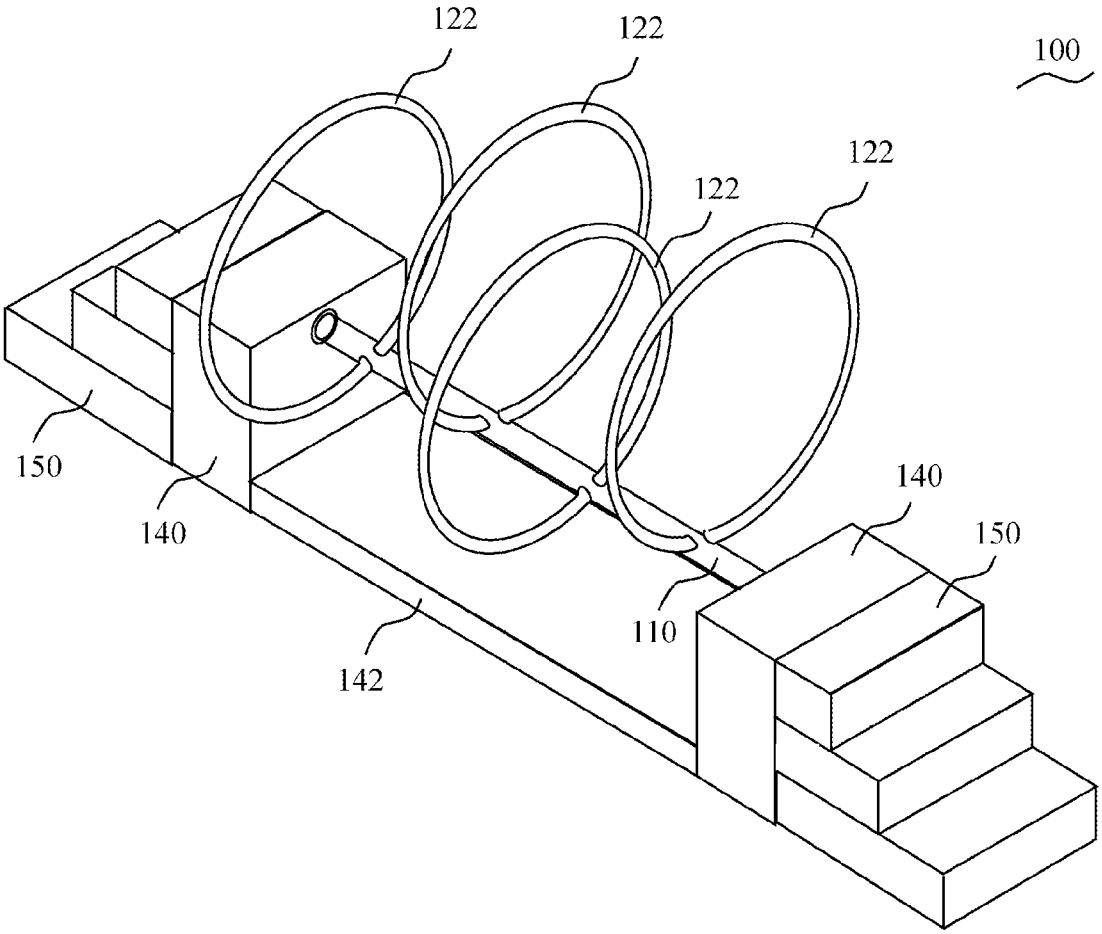
FIG. 3 is a perspective view illustrating an outlined configuration of a play equipment in accordance with an embodiment of the present invention.
Figure 4:
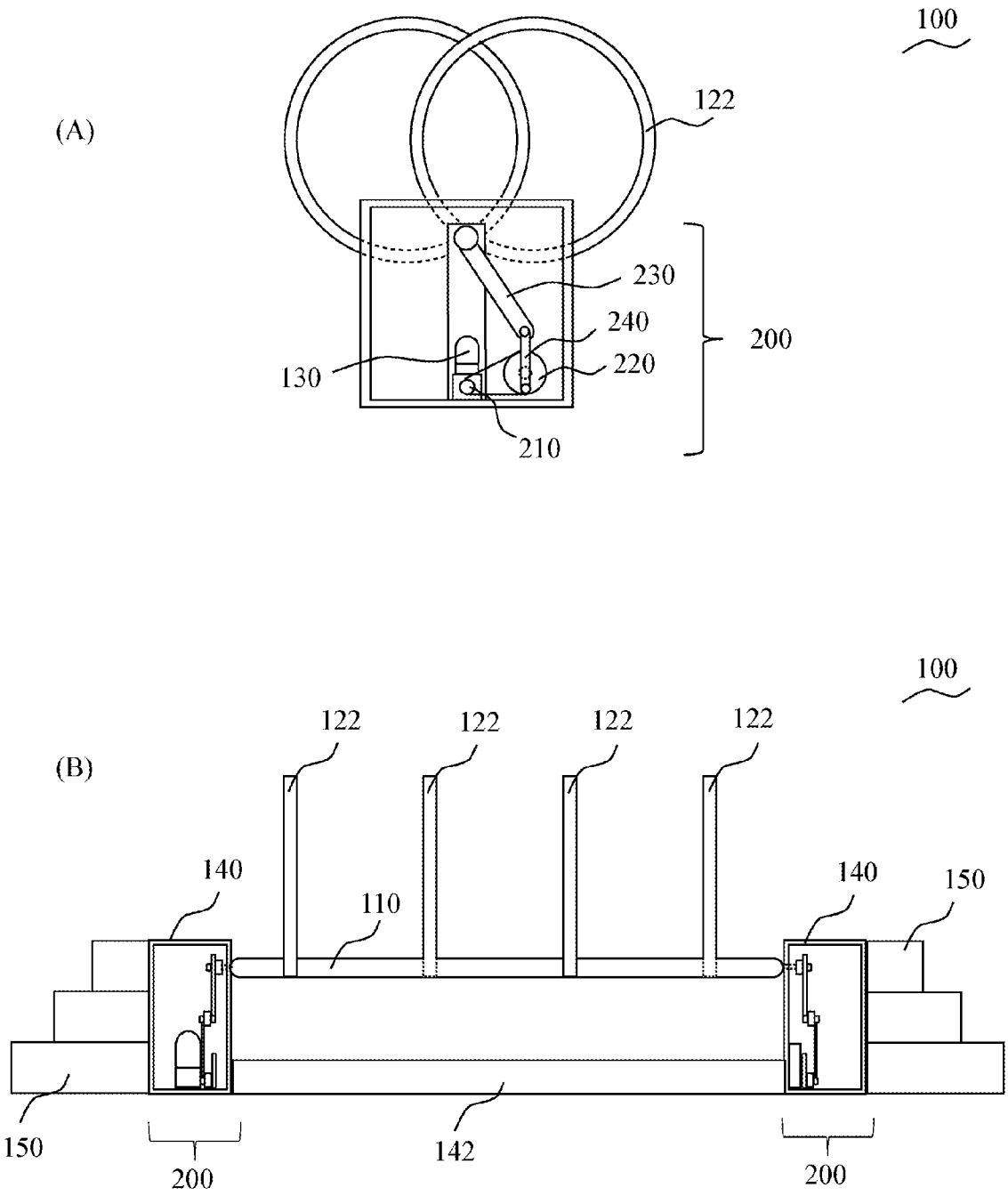
FIG. 4 is a side view and front view illustrating a swing mechanism of a play equipment in accordance with the embodiment of this invention.
Figure 5:
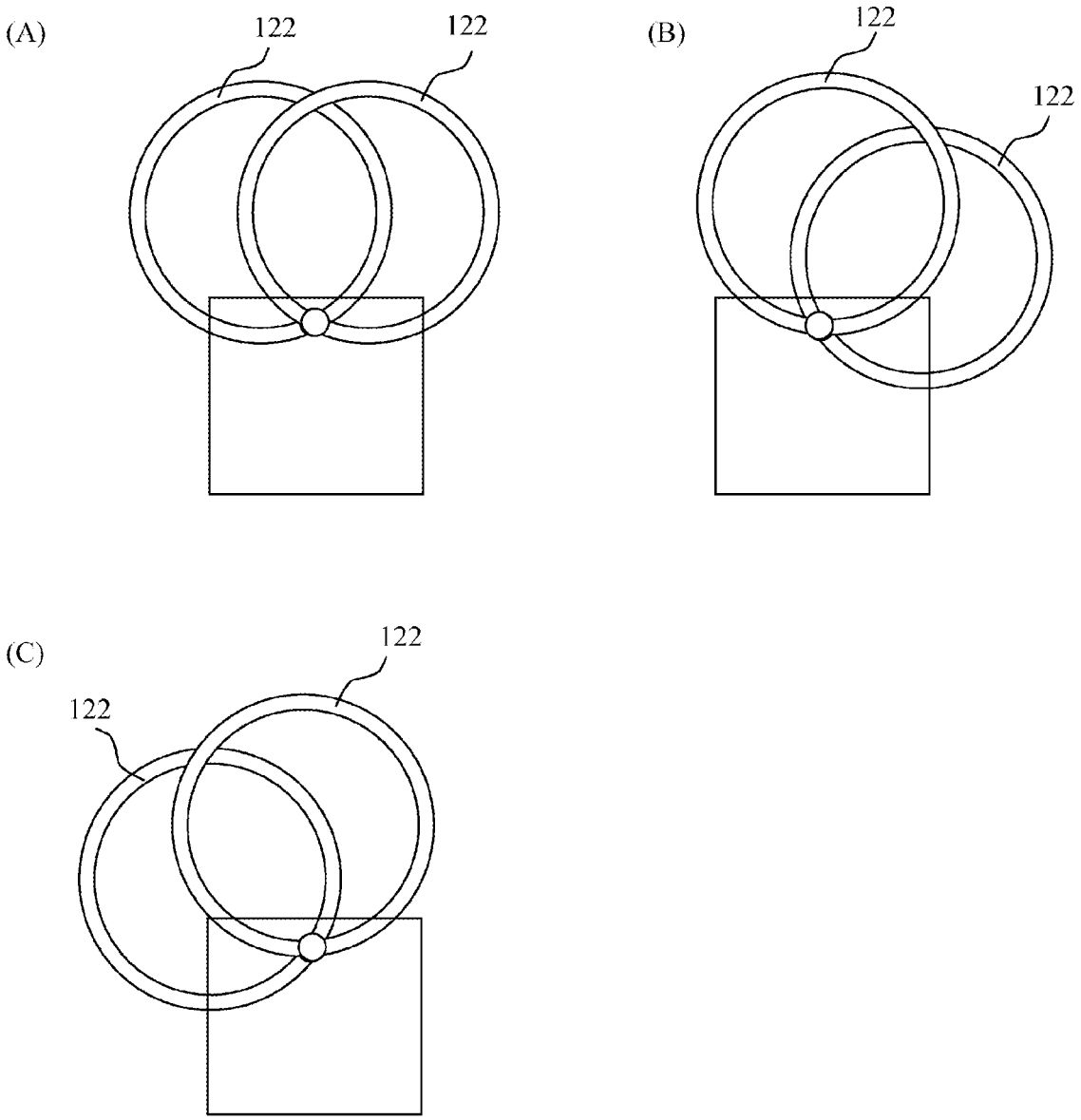
FIG. 5 is a side view illustrating a swing of an obstacle of a play equipment in accordance with the embodiment of this invention.

In the detailed description of the preferred embodiment 1, a pipe body of the spiral shape is formed as the obstacle, and the shaft 110 fixing the obstacle is rotated by the drive motor 130. In this detailed description of the preferred embodiment 2, the shaft 110 is swung while rotating. Other than configuration that the shaft 110 is swung while rotating, embodiment 2 is the same as the play equipment 100 described by embodiment 1, so description is omitted. FIG. 3 is an outline schematic view showing the outlined configuration of play equipment invention, FIG. 4 is an outline schematic view showing the whole configuration of a play equipment 100 of the present invention seen from a lateral view. FIG. 5 is a diagram explaining the movement of ring 122 as described later. However, the details of all parts which do not directly relate to the present invention will be omitted.

FIG. 4 shows the example of the swing mechanism 200. A crank is pivotally supported to the rotational member capable of rotating with the drive motor 130. In the present embodiment, a rotating-side crank 240 is pivotally supported in the place deviated away from the center of the rotational member. Swing crank 230 is pivotally supported to one end of the shaft 110, and a crank mechanism is configured by pivotally supporting the rotating-side crank 240 and the swing crank 230.

It is desirable to use the sprocket as the rotational member. For example, a driving-side sprocket 210 is coupled with a rotation axis of the drive motor 130, and a swing mechanism 200 is configured by connecting a chain for endless belt between the rotating-side sprocket 220 pivotally supporting the rotating-side crank 240 and driving-side sprocket 210. By the swing mechanism 200 configured as above, the play equipment 100 of this invention is configured by swinging the spiral pipe formed of embodiment 1, or as shown in the following, a shaft 110 fixing a plurality of ring arranged with a shaft from a predetermined angle may be swung with above swing mechanism 200. A plurality of rings displaced toward given angle correspond to the obstacle of this invention.

For example, as shown in FIG. 3, the ring 122 spaced between both ends of the pipe bent into a circle shape is formed. The ring 122 bring a central axe axis thereof in line with the long distance direction of the shaft 110 is fixed to the shaft 110. On this occasion, when viewed from longitudinal direction of the shaft 110, the ring 122 is fixed to shaft 110 so that both perpendiculars taken down to the shaft 110 from the center of the ring 122 is displaced toward predetermined angle. In the present embodiment, two or three of the rings 122 having a prescribed distance are fixed to the shaft 110, and other ring 122 is fixed between the rings 122 so that the other ring is displaced to a predetermined angle from the central axis of the shaft 110. That is, the pair of the rings 122 is fixed to above shaft 110 out of a pair of rings 122 so that the each of perpendiculars formed in the central axis of the shaft 110 from the central axis of the pair of ring 122 is displaced.

As shown in FIG. 5, the ring 122 swings from side to side along with the swing of the shaft 110 by fixing the ring 122 as above. The user plays with in response to the swing of the ring 122. For example, they walk on the shaft 110 while avoiding the ring 122 which is obstacle by passing through or stepping over the ring 122.

Detailed Description of the Preferred Embodiment 3

In the following, other configuration of the swing mechanism 200 is explained. The configuration other than the swing mechanism 200 is the same as the play equipment 100 described by embodiment 1 or 2, so description is omitted.

Figure 6:
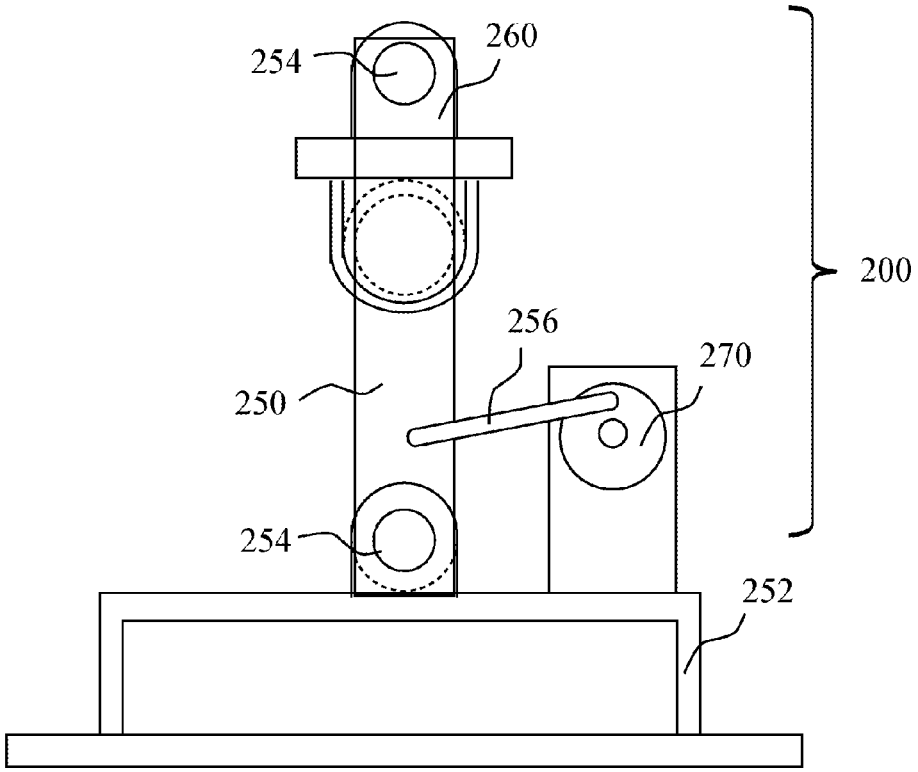
FIG. 6 is a side view illustrating an outlined configuration of a play equipment in accordance with an embodiment of the present invention.

As shown in FIG. 6, as for the swing mechanism 200 of the present example, the swing member is pivotally supported on a support. In the swing member, a swing mechanism 200 swung by the crank mechanism placed on the support in the same way is configured. The swing member comprises a swing strut 250 pivotally supported on a strut support 252 and an upper part swing 260 pivotally supported on the upper part of the swing strut 250. Of course, the swing strut 250 and the strut support 252 are connected via a bearing 254, also the swing strut 250 and the upper swing 260 are connected via the bearing 254.

Furthermore, swing strut 250 is swung. That is, a swing crank 256 is pivotally supported to a rotational member (e.g., driving-side sprocket 270) driven by the drive motor 130, the swing crank 256 and the swing strut 250 are connected (the driving side sprocket 270 and the swing crank 256 correspond to the crank mechanism of this invention). By the configuration, rotation of the drive motor 130 allows crank mechanism to swing the swing strut 250. Furthermore, because the upper swing 260 swings against the swing strut 250, the upper swing 260 swings against the swing strut 250 depending on the movement of the users.

Figure 7:
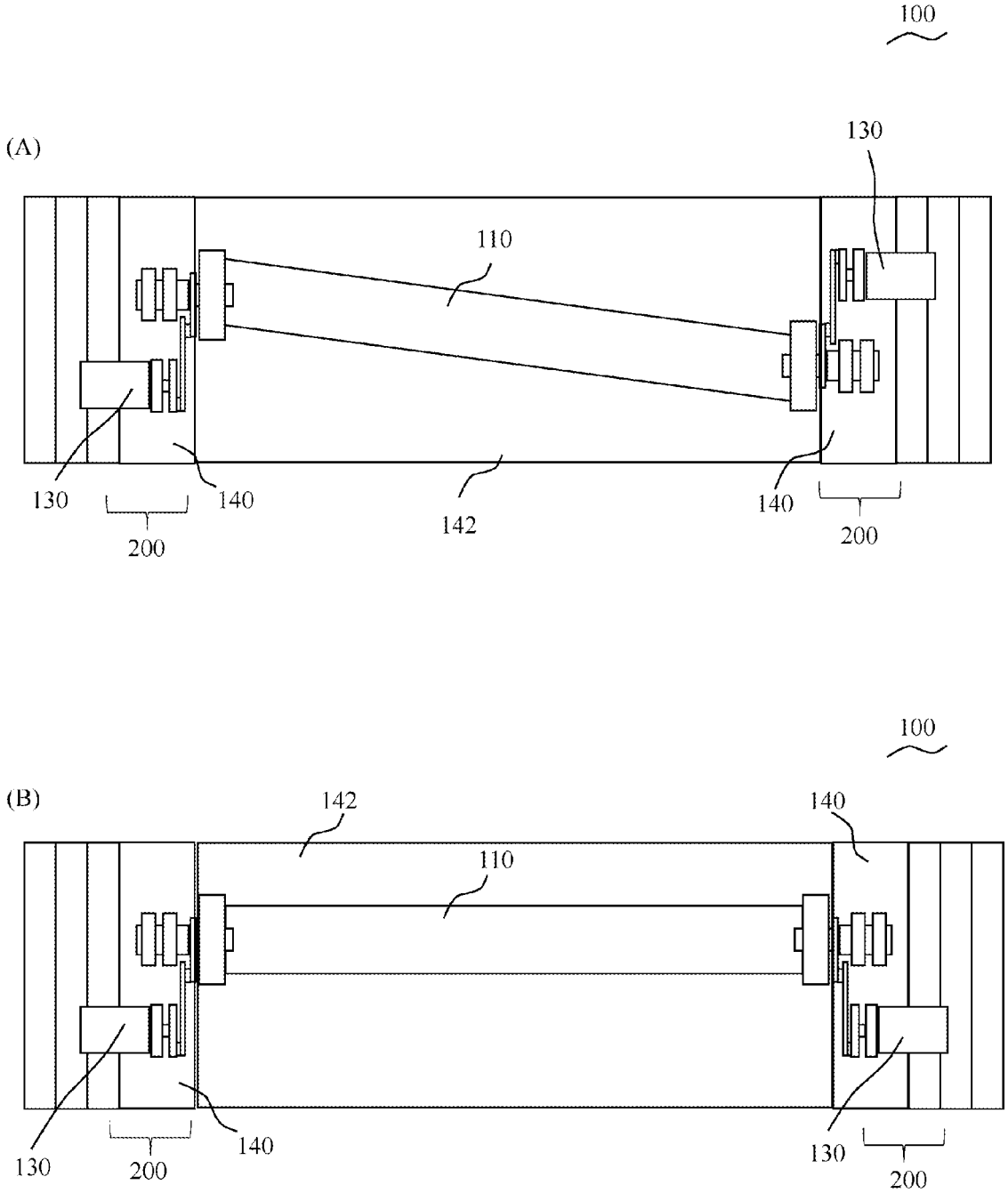
FIG. 7 is a top view illustrating a swing mechanism of a play equipment in accordance with the embodiment of this invention.

In addition, as shown in FIG. 7, the shaft 110 swings so that swing direction of each swing mechanism 200 comes to opposite, respectively. The displacement of one or both ends of the shaft 110 is controlled freely in intersection direction against longitudinal. Above control can be composed, for example, with inverter not shown in the figure.

Others Embodiment

Figure 8:
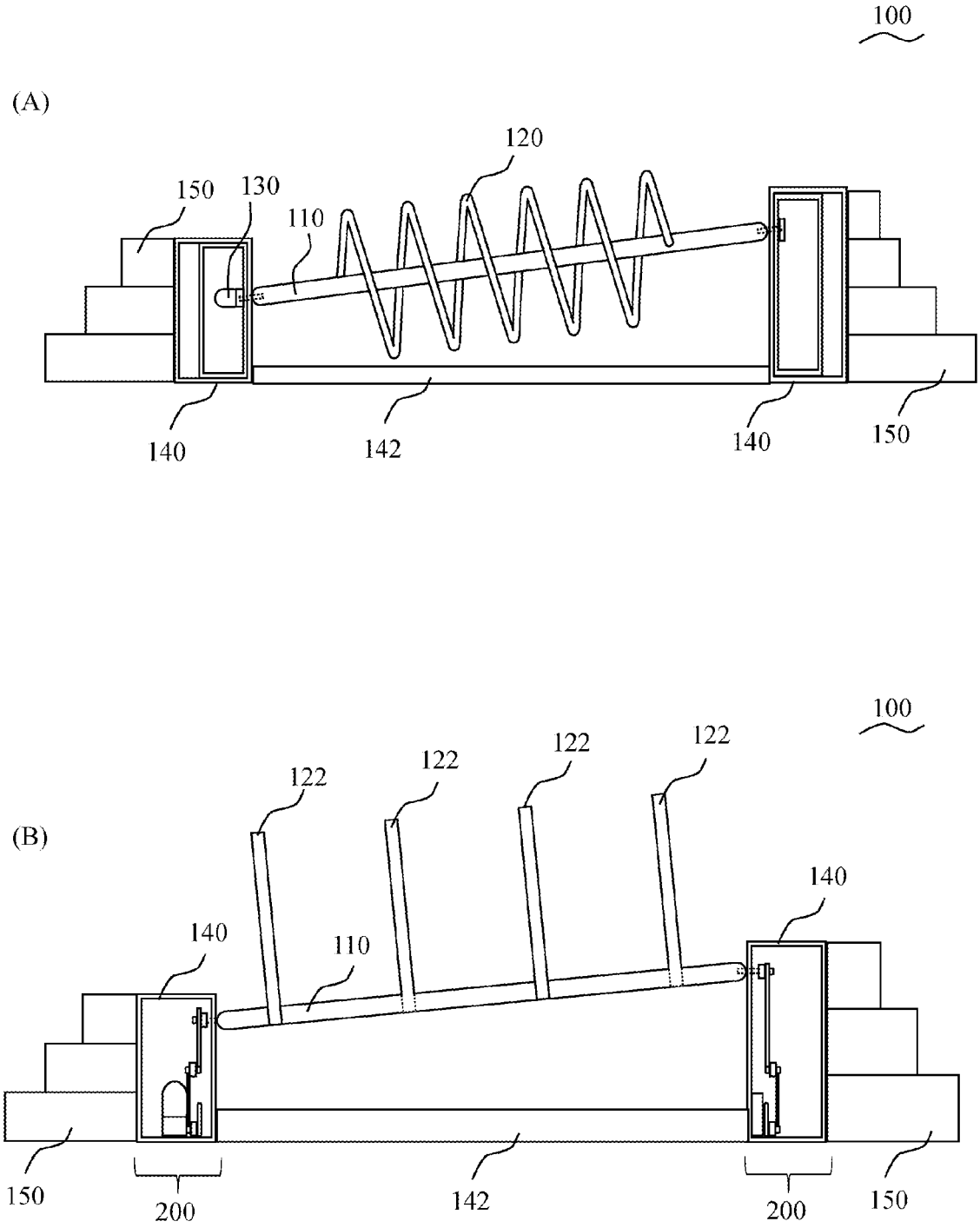
FIG. 8 is a front view illustrating a swing mechanism of a play equipment in accordance with the embodiment of this invention.

As shown in FIG. 8, the play equipment 100 comprising the swing mechanism 200 or rolling mechanism of this invention can be configured in a sloping shaft 110 against floor (horizontal plane). The shaft 110 can be swung or rotated in a sloping state by coupling the ends of the sloped shaft 110 to the swing mechanism 200 or rolling mechanism via a swivel-bearing not to illustrate. The configuration such as the swing mechanism 200 or the rolling mechanism is the same as the play equipment described by embodiments 1 to 3, so description is omitted. A overcurrent protection means (such as a torque limiter) for protecting against overload of the drive motor 130 for driving the rolling mechanism or swing mechanism 200 may be attached to the rotation axis of the drive motor 130. As mentioned above, users hoping to play walk on the shaft 110, so the load for the weight of the user is applied on the drive motor 130. If the loads more than specified is added to the drive motor 130, the overload protection means detects the load, and idles the drive motor 130.

That is, a torque limiter for protecting the drive motor 130 from a surplus torque and a torque sensor for detecting running torque are provided between output shaft (mean rotating shaft) of the drive motor 130 and the shaft 110. As the torque sensor, a contact-type torque sensor may be used, alternatively a noncontact torque sensor may be used too. If a torque detected by the torque sensor is beyond an expected limit, the rotative power from the drive motor 130 is not transmitted to the shaft 110 by the torque limiter.

When the electric current higher than expected limit flows in the drive motor by being overloaded, the electric current to the drive motor 130 may be interrupted by inverter control. If the play equipment of this invention is installed as indoor play equipment, power source (e.g., commercial power supply) of the drive motor 130 provided in the play equipment is provided on the indoor amusement park installed with the play equipment.

INDUSTRIAL APPLICABILITY

A play equipment of this invention comprises a pair of pedestals placed on a floor, a shaft for walking a user, an obstacle that interferes with the user's walking, and drive mechanism. The ends of the shaft are supported rotatably on the pair of pedestals.

An obstacle is disposed on the shaft. Furthermore, a drive mechanism comprising a drive motor for driving the shaft is comprised. The play equipment capable of disturbing the user's walk can configure by driving the obstacle provided on the shaft.

As described above, a play equipment capable of user's walking over shaft is configured while avoiding driven obstacle, and play equipment capable of sustaining the more interest of the user is configured. The play equipment which can sustain the interest of the user by simple configuration is offered, which makes it industrially useful.

What is claimed is:

1. A play equipment, comprising:
a pair of pedestals placed on a floor;
a shaft on which a user walks, the shaft comprising two ends, the two ends of the shaft are supported rotatably on the pair of pedestals;
an obstacle placed on the shaft for interfering with the user's walking, such that the user avoids the obstacle by passing through the obstacle;
a drive motor provided in the pedestal; and
a drive mechanism for driving the shaft by a rotation of the drive motor.

2. The play equipment according to claim 1, wherein said drive mechanism is a rolling mechanism for turning the shaft, and said obstacle is a spiral body.

3. The play equipment according to claim 1, wherein said obstacle is a plurality of rings, wherein the rings each comprise a circle shape, a lower end of each ring being placed to the shaft.

4. The play equipment according to claim 1,
wherein said drive mechanism, comprising:
a strut;
an upper swing pivotally supported by an upper part of the strut; and
a crank mechanism for swinging the upper swing.

5. The play equipment according to claim 1, wherein said drive mechanism, comprising:
a strut support;
a swing strut pivotally supported by the strut support;
an upper swing pivotally supported by an upper part of the swing strut; and
a crank mechanism for swinging the upper swing.

6. The play equipment according to claim 1, wherein the shaft is a sloping shaft, pivotally supported by the pedestals.

7. The play equipment according to claim 1, wherein a displacement of one or both ends of the shaft is controlled freely in intersection direction against longitudinal.

8. The play equipment according to claim 3, wherein at least one of the plurality of rings is displaced to a predetermined angle from a central axis of the shaft.

9. A play equipment, comprising:
a pair of pedestals placed on a floor;
a shaft on which a user walks, the shaft comprising two ends, the two ends of the shaft are supported rotatably on the pair of pedestals;
an obstacle placed on the shaft, for interfering with the user's walking;
a drive motor provided in the pedestal; and
a drive mechanism for driving the shaft by a rotation of the drive motor,
wherein said drive mechanism is a rolling mechanism for turning the shaft, and said obstacle is a spiral body.

10. A play equipment, comprising:
a pair of pedestals placed on a floor;
a shaft on which a user walks, the shaft comprising two ends, the two ends of the shaft are supported rotatably on the pair of pedestals;
an obstacle placed on the shaft, for interfering with the user's walking;
a drive motor provided in the pedestal; and
a drive mechanism for driving the shaft by a rotation of the drive motor,
wherein said obstacle is a plurality of rings, wherein the rings each comprise a circle shape, a lower end of each ring being placed to the shaft.

* * * * *